United States Patent [19]

Trout

[11] Patent Number: 4,988,092

[45] Date of Patent: Jan. 29, 1991

[54] BREAK-DOWN THERAPEUTIC WALKER WITH FOOT SEPARATOR

[76] Inventor: Travis Trout, P.O. Box 131, Meridian, Tex. 76665

[21] Appl. No.: 316,804

[22] Filed: Feb. 28, 1989

[51] Int. Cl.[5] ..... A63B 3/00

[52] U.S. Cl. ..... 272/70; 434/255

[58] Field of Search ..... 272/70, 63, 62, 113; 273/55 R; 434/251, 255

[56] References Cited

U.S. PATENT DOCUMENTS

| | | | |
|---|---|---|---|
| 1,982,843 | 12/1934 | Traver | 272/70 |
| 2,239,200 | 4/1941 | Peterson | 434/251 X |
| 2,354,050 | 7/1944 | Paupa | 434/255 |
| 2,685,140 | 8/1954 | Nedwick | 434/255 |
| 2,690,789 | 10/1954 | Zadrazny | 272/70 |
| 3,747,233 | 7/1973 | Berryman | 434/255 |

FOREIGN PATENT DOCUMENTS

| | | | |
|---|---|---|---|
| 563936 | 7/1922 | France | 272/70 |

*Primary Examiner*—Richard J. Apley
*Assistant Examiner*—H. Flaxman
*Attorney, Agent, or Firm*—Charles Fallow; Martin Hoffman

[57] ABSTRACT

A therapeutic walker comprises a floor plate with a center board extending upwardly therefrom to maintain lateral spacing between a child's feet as he walks along the board. The ends of the center board are supported by end plates bearing stanchions which receive the legs of a rail assembly. The rails can be adjusted vertically and horizontally for various sized patients.

8 Claims, 2 Drawing Sheets

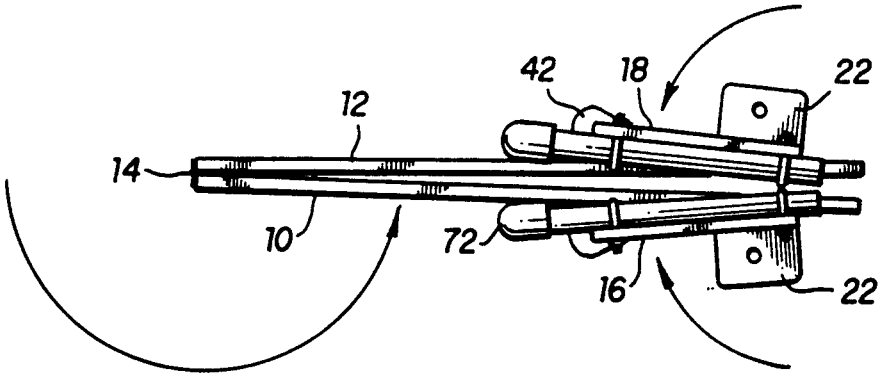
FIG. 3
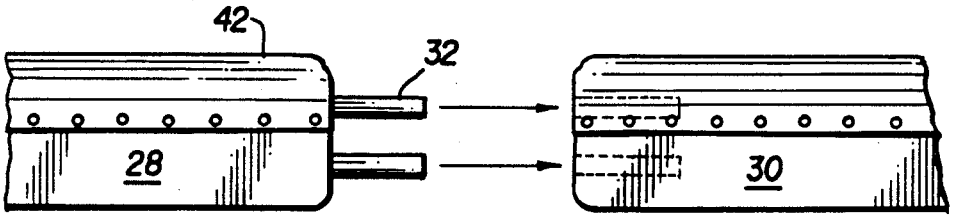
FIG. 4
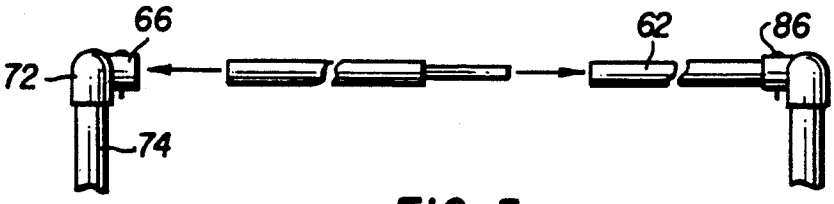
FIG. 5
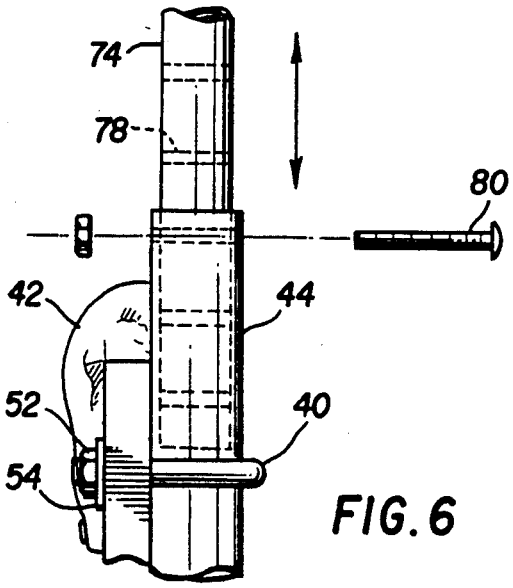
FIG. 6
FIG. 7
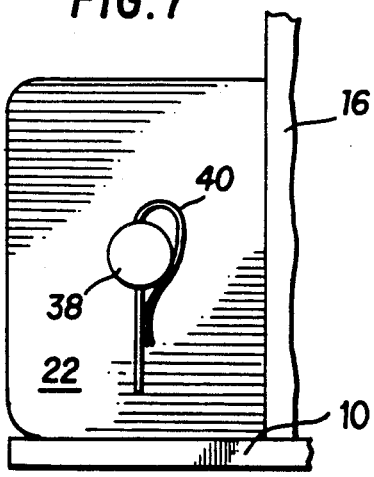

BREAK-DOWN THERAPEUTIC WALKER WITH FOOT SEPARATOR

BACKGROUND

This invention relates generally to the art of pediatrics and more particularly to a therapeutic device for children with certain types of walking disorders.

Young victims of cerebral palsy and other disabling diseases may require physical therapy to improve their walking. It has been found that beneficial results are obtained in some instances by constraining the child's feet to remain on opposite sides of a center plane while walking.

Various baby walkers and therapeutic devices are already known. U.S. Pat. No. 2,690,789, for example, discloses an apparatus for the purpose of rehabilitating people of various ages, and for this purpose provides a pair of parallel bars supported by slidable sleeves on the upper ends of vertical posts, so as to accommodate people of different sizes. Other generally pertinent U.S. Pat Nos. include 642,435, 761,514, 839,681, 1,154,543, 1,222,664, and 4,549,732. In none of the prior art of which applicant is aware, however, has it been proposed to provide a center board for separating the feed of the patient. Additionally, prior devices are typically bulky and thus difficult to move or store.

SUMMARY OF THE INVENTION

It is therefore an object of the invention to provide an apparatus that requires a child to place his feet on opposite sides of his line of travel as he walks.

Another object is to provide such an apparatus with adjustability for patients of different sizes.

A further object of the invention is to enable one to knock down the apparatus to a size that can be easily transported.

These and other objects are met by a therapeutic walker comprising a floor plate, a center board extending vertically upward from the floor plate and lengthwise along a center plane thereof, a pair of end plates mounted at respective ends of the center board, and a pair of spaced rails, extending parallel to said center board, and the rails to the end plates. The center board, floor plate, and rails preferably may be folded or broken down to shorter lengths, so as to be easily stored or transported.

BRIEF DESCRIPTION OF THE DRAWINGS

In the accompanying drawings.

FIG. 3 is a side elevation of a portion of the apparatus in its collapsed position;

FIG. 4 is an exploded view of a divider portion of the apparatus;

FIG. 5 is an exploded view of a top rail of the apparatus;

FIG. 6 is an exploded view of a stanchion portion thereof; and

FIG. 7 is a side elevation of a rear portion thereof.

DESCRIPTION OF THE PREFERRED EMBODIMENT

Figure 1:
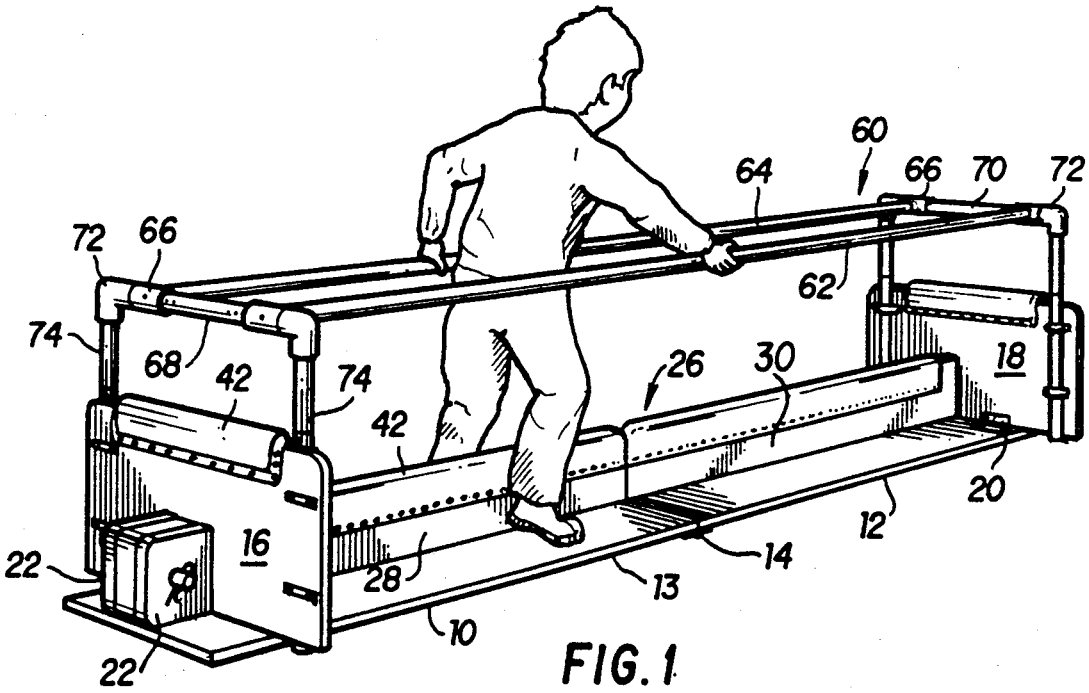
FIG. 1 is a perspective view of a therapeutic walker embodying the invention.

A therapeutic walker embodying the apparatus is shown fully assembled in FIG. 1. The apparatus includes a floor plate 10 formed in two halves 12, 13 interconnected by a hinge 14 extending along a transverse axis substantially bisecting the walker. ("Transverse" connotes a direction widthwise of the apparatus; "longitudinal" means lengthwise thereof.)

Figure 2:
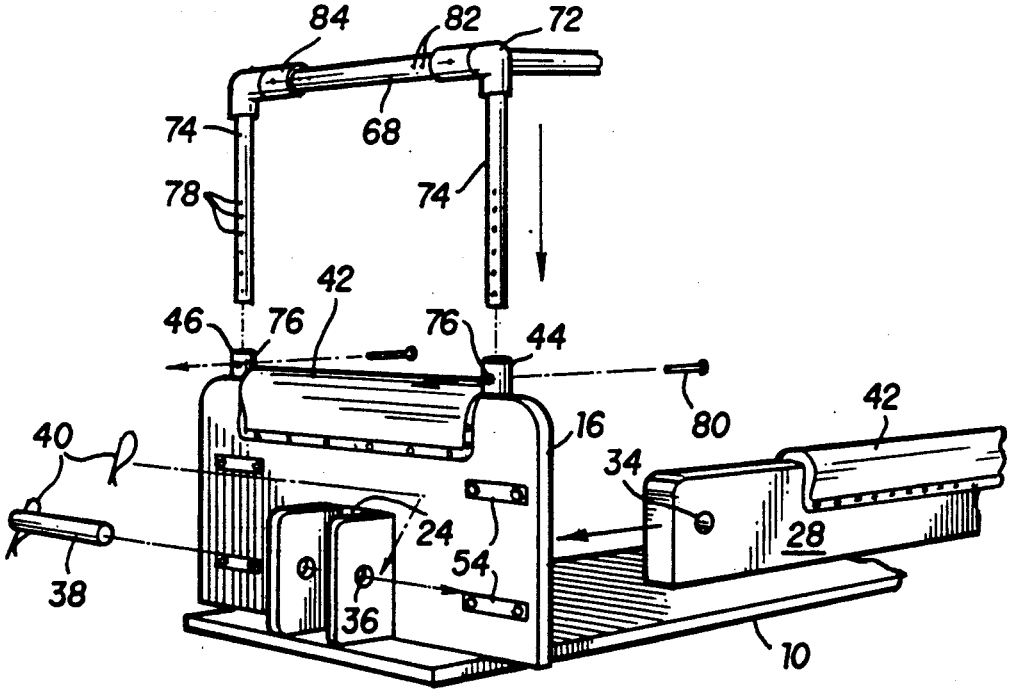
FIG. 2 is an exploded view of a rear portion of the apparatus.

End plates 16, 18 lie in respective parallel vertical transverse planes. The end plates rest on and are supported by the floor plate, and are connected thereto by means of hinges 20 so arranged as to permit the end plates to fold inwardly toward one another, upon disassembly (FIG. 3). Each end plate has a pair of tabs 22, each of which extends longitudinally away from the center of the apparatus, on either side of a rectangular aperture 24 (FIG. 2) in the end plate.

A vertical center board 26 (FIG. 1), comprising two like segments 28 and 30, extends upwardly from and lengthwise along the floor plates. At their inner ends, that is, their mutually abutting ends, the segments 28 and 30 have dowel holes; dowels 32 (FIG. 4) permanently inserted into the holes of one of the segments are inserted into opposing holes when the walker is assembled. The outer end of each segment has a through hole 34 (FIG. 2), and each of the end plate tabs 20, 22 has a transverse through hole 36 of similar diameter. A clevis pin 38, retained by a pair of retainers 40, passes through the holes 34, 34 and 36, retaining the ends of the center board between the tabs.

The upper edges of the end plates, and of the center board segments, are covered with cushion material 42 to prevent injury if the patient should fall.

Each of the end plates has connected thereto a pair of parallel tubular stanchions 44, 46 (FIG. 2), which extend vertically and are secured against the inward surface of each end plate by a pair of U-bolts 48 (FIG. 6) passing through holes in the end plates, and tightened by nuts 52 on the opposite side of retaining plates 54.

Referring again to FIG. 1, rail assembly 60 comprises a pair of longitudinal rails 62, 64 attached by tees 66 between transverse bars 68, 70 which in turn are connected by elbows 72 to the upper ends of tubular legs 74. The legs have an outer diameter slightly less that the inside diameter of the stanchions, so that they are slidable therein. Each stanchion has a longitudinally extending hole 76 (FIG. 2) at its upper end, and the vertical bars have a series of corresponding holes 78, through one of which a retaining screw 80 (FIG. 6) is inserted, thus enabling one to adjust the rail assembly height. Similarly, the transverse bars are provided with plural holes 82 for pins 84 securing the tees, so that the spacing between the rails may be varied. The ends of the rails 62, 64 are secured within the ends of the tees by pins 86.

The rails 62, 64 are preferably constructed from PVC tubing, reinforced internally by metal pipes for strength. Alternatively, the rails could be constructed from plastic-coated metal pipe. It is preferred that the rails be constructed in segments, so as to break down to small lengths like the floor plate and center board.

In order to disassemble the walker, one removes the pins 86 and removes the rails 62, 64. The retainers 40 are then removed, and the clevis pins 38 withdrawn, whereupon the center board segments can be pulled out of the end plates. The end plates are then folded downward against the floor plates, and the floor plates are folded bottom to bottom to arrive at the configuration of FIG. 3, which is easily stowed in a vehicle for transportation.

Assembly, disassembly and transportation of the device are thus simple matters requiring little time and no special tools or skills.

The floor and end plates may be constructed of plywood or like material, or from plastic such as a polyurethane. The choice of materials is within the skill of the artisan. Inasmuch as the invention is subject to other variations and modifications, it is intended that the foregoing description and the accompanying drawings shall be interpreted merely as illustrative of the invention defined by the following claims.

I claim:

1. A therapeutic walker comprising a floor plate upon which a patient may walk, a center board extending vertically upward from the floor plate and lengthwise along a center plane thereof, for keeping the feet of the patient apart, a pair of end plates supporting respective ends of said center board, a pair of spaced longitudinal hand rails, extending parallel to said center board, means for connecting said rails to said end plates, and means for releasably connecting each of said end plates to a respective end of said floor plate, wherein each of said end plates has an aperture therein for receiving a respective end of said center board, and said connecting means is applied to a portion of the center board extending through the aperture.

2. The invention of claim 1, wherein each of said end plates has a pair of tabs extending along opposite edges of said aperture, said tabs having aligned through holes therein, and said center board having a hole in each end thereof, alignable with the tab holes, and further comprising a clevis pin for insertion through said holes.

3. The invention of claim 2, wherein said floor plate is formed in two halves, and further comprising a hinge interconnecting said halves, whereby the floor plate can be folded in half upon disassembly.

4. The invention of claim 2, further comprising two pairs of stanchions, one pair affixed to each of said end plates astride said center board.

5. The invention of claim 4, wherein said connecting means comprise a pair of transverse hand rails supporting respective ends of said longitudinal bars, and two pairs of vertical bars, each of said vertical bars extending downward from a respective end of one of said transverse bars and into a respective one of said stanchions.

6. The invention of claim 5, wherein each of said vertical bars has a series of transverse through holes therein to enable one to adjust vertical height of the longitudinal hand rails.

7. The invention of claim 5, further comprising means for adjusting the lateral separation of said longitudinal bars.

8. The invention of claim 2, further comprising a pair of transverse hinges, each connecting one of said end plates to a respective end of said floor plate, whereby said end plates can be folded against said floor plate when the walker is disassembled.

* * * * *